US005743622A

United States Patent [19]

Ibbitson et al.

[11] Patent Number: 5,743,622

[45] Date of Patent: Apr. 28, 1998

[54] LANDSCAPE LIGHT WITH ANTI-WICKING ELEMENTS AND ELONGATED BASE

[75] Inventors: Ian R. Ibbitson, Seal Beach; Frank G. Watson, Long Beach, both of Calif.

[73] Assignee: Architectural Landscape Lighting, Santa Ana, Calif.

[21] Appl. No.: 698,232

[22] Filed: Aug. 14, 1996

[51] Int. Cl.[6] ..... E01F 9/00; F21S 1/02

[52] U.S. Cl. ..... 362/153.1; 362/145; 362/153

[58] Field of Search ..... 362/153, 153.1, 362/267, 145

[56] References Cited

U.S. PATENT DOCUMENTS

| | | | |
|---|---|---|---|
| Re. 34,709 | 8/1994 | Tyson | 362/96 |
| 3,845,435 | 10/1974 | Georgopulos | 336/65 |
| 3,869,563 | 3/1975 | Ocken, Jr. | 174/52 |
| 3,949,213 | 4/1976 | Paitchell | 240/26 |
| 4,000,406 | 12/1976 | Bhavsar | 240/11.2 |
| 4,143,508 | 3/1979 | Ohno | 58/23 |
| 4,180,850 | 12/1979 | Bivens | 362/145 |
| 4,343,033 | 8/1982 | Suzuki | 362/307 |
| 4,344,118 | 8/1982 | Rundquist et al. | 362/267 |
| 4,396,972 | 8/1983 | Kaneko et al. | 362/145 |
| 4,433,366 | 2/1984 | Wade | 362/267 |
| 4,460,944 | 7/1984 | Gordbegli et al. | 362/276 |
| 4,507,715 | 3/1985 | Wedding | 362/153 |
| 4,539,629 | 9/1985 | Poppenheimer | 362/267 |
| 4,574,337 | 3/1986 | Poppenheimer | 362/267 |

(List continued on next page.)

OTHER PUBLICATIONS

Technical Specification For AG10, AG12, AG18 Surface Installation Option For 5100 Or 5200 Series Ground Mount Precision Uplights.

Technical Specification For Low Voltage Incandescent Ground Mount Precision Lights—Lexan Dome With Convex Tempered Lens.

Technical Specification For H.I.D. Ground Mount Precision Uplights—Wall Wash Reflector With Convex Tempered Lens.

Technical Specification For H.I.D. Ground Mount Precision Uplights—Convex Guard With Convex Tempered Lens.

Technical Specification For H.I.D. Ground Mount Precision Uplights—Flush Guard With Convex Tempered Lens.

Technical Specification For H.I.D. Ground Mount Precision Uplights—Lexan Dome With Convex Tempered Lens.

Bronzelite Bulletin 8218–1293, 1993, pp. 1, 2, 4, 5, 7 and 16.

(List continued on next page.)

*Primary Examiner*—James C. Yeung
*Assistant Examiner*—Matthew Spark
*Attorney, Agent, or Firm*—Fitzpatrick, Cella, Harper & Scinto

[57] ABSTRACT

An in-ground light fixture includes a single unitary body having a first chamber and a second chamber, the first chamber and the second chamber being separated by a common wall, and plural conductive elements, each of which is molded within the common wall separating the first chamber and the second chamber and each of which forms a conductive pathway between the first chamber and the second chamber. The first chamber contains at least electrical components and a light source, and has an opening for receiving a lens, and the second chamber has an opening adapted to receive a power cable supplying power from an external power source. The plural conductive elements permit power to be supplied from the second chamber to the electrical components and the light source in the first chamber. The in-ground light is also adaptable for use as an elevated landscape light so as to provide lighting above grade level. According to the invention, the light housing has a lip extending therefrom, wherein the lip has at least one boss extending therefrom and has a diameter greater than the diameter of the housing. An elongated base having a length greater than the length of the housing and having an open end receives the light housing and is fastened to the at least one boss that extends from the lip.

21 Claims, 8 Drawing Sheets

U.S. PATENT DOCUMENTS

| | | | |
|---|---|---|---|
| 4,617,616 | 10/1986 | Juell et al. | 362/267 |
| 4,695,930 | 9/1987 | Wierzbicki et al. | 362/293 |
| 4,744,014 | 5/1988 | Harris | 362/153 |
| 4,931,915 | 6/1990 | Quiogue | 362/267 |
| 4,947,307 | 8/1990 | Quiogue | 362/325 |
| 4,956,561 | 9/1990 | Tamer | 307/10.1 |
| 4,984,139 | 1/1991 | Goggia | 362/153.1 |
| 5,029,054 | 7/1991 | Trainor | 362/153.1 |
| 5,041,950 | 8/1991 | Tyson | 362/96 |
| 5,050,052 | 9/1991 | Wade | 362/101 |
| 5,072,345 | 12/1991 | Goggia | 362/153.1 |
| 5,144,542 | 9/1992 | Puglisi | 362/153.1 |
| 5,156,454 | 10/1992 | White | 362/153 |
| 5,198,962 | 3/1993 | Tyson | 361/380 |
| 5,207,499 | 5/1993 | Vajda et al. | 362/96 |
| 5,276,583 | 1/1994 | Tyson | 361/679 |
| 5,335,151 | 8/1994 | Dahlberg | 362/153.1 |
| 5,408,397 | 4/1995 | Tyson | 362/267 |
| 5,414,603 | 5/1995 | Conway | 362/153.1 |
| 5,436,812 | 7/1995 | Stewart | 362/153.1 |
| 5,481,443 | 1/1996 | Wagner et al. | 362/153.1 |
| 5,486,988 | 1/1996 | Tyson | 362/153.1 |
| 5,541,362 | 7/1996 | Reinert, Sr. | 362/153.1 |
| 5,556,189 | 9/1996 | Wallis | 362/153.1 |

OTHER PUBLICATIONS

Kim Lighting Brochure, Version 6/95, pp. 2, 3, 8, 9 and 20.
Hydrel 9000 Series Brochure.
Hadco Brochure, 1996, pp. 24–25.
GreenLee Lighting Inc. Brochure, 1995, pp. 24–26.
Architectural Landscape Lighting SL–03 Specification 1995.
Architectural Landscape Lighting SL–04 Specification 1995.
Architectural Landscape Lighting SL–07 Specification 1995.
Architectural Landscape Lighting SL–08 Specification 1995.
Architectural Landscape Lighting SL–32 Specification 1995.

LANDSCAPE LIGHT WITH ANTI-WICKING ELEMENTS AND ELONGATED BASE

BACKGROUND OF THE INVENTION

1. Field of the Invention

The present invention relates to a light housing for an outdoor light fixture that is exposed to the elements, such as rain, snow, etc. More specifically, the present invention is a landscape light housing for an in-ground light that shines light upwards, for example, onto trees, buildings, and the like, either from the ground or from a position elevated above the ground. Such lighting, called up-lighting, is commonly used to provide accent lighting and to beautify an area without noticeably invading the area's space.

2. Description of the Related Art

Conventional landscape light fixtures used for up-lighting are disposed in the ground. These in-ground landscape light fixtures have a housing which contains a light source, electrical components such as a ballast, and power terminals. Power enters these conventional fixtures by means of a power cable passing through a hole or a junction box.

Tubular fittings, water-tight couplings, gaskets and the like are used in an attempt to prevent water from entering the fixtures from the surrounding ground through the hole or junction box. In addition, a potting compound such as epoxy is sometimes used to surround electrical components and contacts within the fixture in order to protect them from water. However, forming a truly water-tight seal with any of these conventional means can be difficult because of water's ability to siphon or wick, possibly by means of capillary action, through the smallest opening or along boundaries between materials.

Another problem with conventional up-lighting is that the light can become obscured by low-growing shrubs and other plants, leaves, grass clippings and other obstructions close to the ground. When the light is obscured, the light neither provides accent lighting nor beautifies the area.

SUMMARY OF THE INVENTION

The present invention addresses the foregoing deficiencies by providing an in-ground light fixture which includes a single unitary body having a first chamber and a second chamber separated by a common wall, and plural conductive elements molded within the common wall, each of which forms a conductive pathway between the chambers.

In another aspect, the invention provides an in-ground light fixture which includes a first chamber and a second chamber separated by a common wall and plural conductive elements. The plural conductive elements are molded within the common wall, and each conductive element forms a conductive pathway between the first chamber and the second chamber. The first chamber contains at least electrical components and a light source, and has an opening for receiving a lens. The second chamber has an opening adapted for receiving a power cable supplying power from an external power source. The plural conductive elements permit power to be supplied from the second chamber to the electrical components and the light source in the first chamber.

In yet another aspect, the invention provides an in-ground light fixture which includes a chamber containing at least electrical components and a light source, and has an opening for receiving a lens. Plural conductive elements are molded within a wall of the chamber, and each conductive element forms a conductive pathway from outside of the chamber to inside of the chamber. The plural conductive elements permit power to be supplied from outside of the chamber to the electrical components and the light source inside of the chamber.

In yet another aspect, the invention provides a housing which includes plural walls, at least one of the plural walls preventing water from entering the housing, and at least one conductive element molded within that wall so as to form a conductive pathway from one side of the wall to an other side of the wall.

In yet another aspect, the invention provides an in-ground light adaptable for use as an elevated landscape light so as to provide lighting above grade level. The in-ground light includes a housing having at least an opening for receiving a lens, an opening for receiving a power cable, at least one chamber containing at least electrical components and a light source, and a lip extending from the housing. The lip has at least one boss extending therefrom and has a diameter greater than the diameter of the housing. The adaptable light also includes an elongated base having a length greater than the length of the housing and having an open end adapted to receive the housing, the open end having an inside diameter less than the diameter of the lip and greater than the diameter of the housing, and fasteners for fastening the elongated base to the at least one boss that extends from the lip.

DETAILED DESCRIPTION OF THE PREFERRED EMBODIMENTS

According to the preferred embodiment, the present invention is an in-ground light fixture which includes a single unitary body having a first chamber and a second chamber, the first chamber and the second chamber being separated by a common wall, and plural conductive elements, each of which is molded within the common wall separating the first chamber and the second chamber and each of which forms a conductive pathway between the first chamber and the second chamber. The first chamber contains at least electrical components and a light source, and has an opening for receiving a lens. The second chamber has an opening adapted to receive a power cable supplying power from an external power source. The plural conductive elements permit power to be supplied from the second chamber to the electrical components and the light source in the first chamber. The in-ground light fixture is described in detail below with reference to FIGS. 1 through 3.

Figure 1:
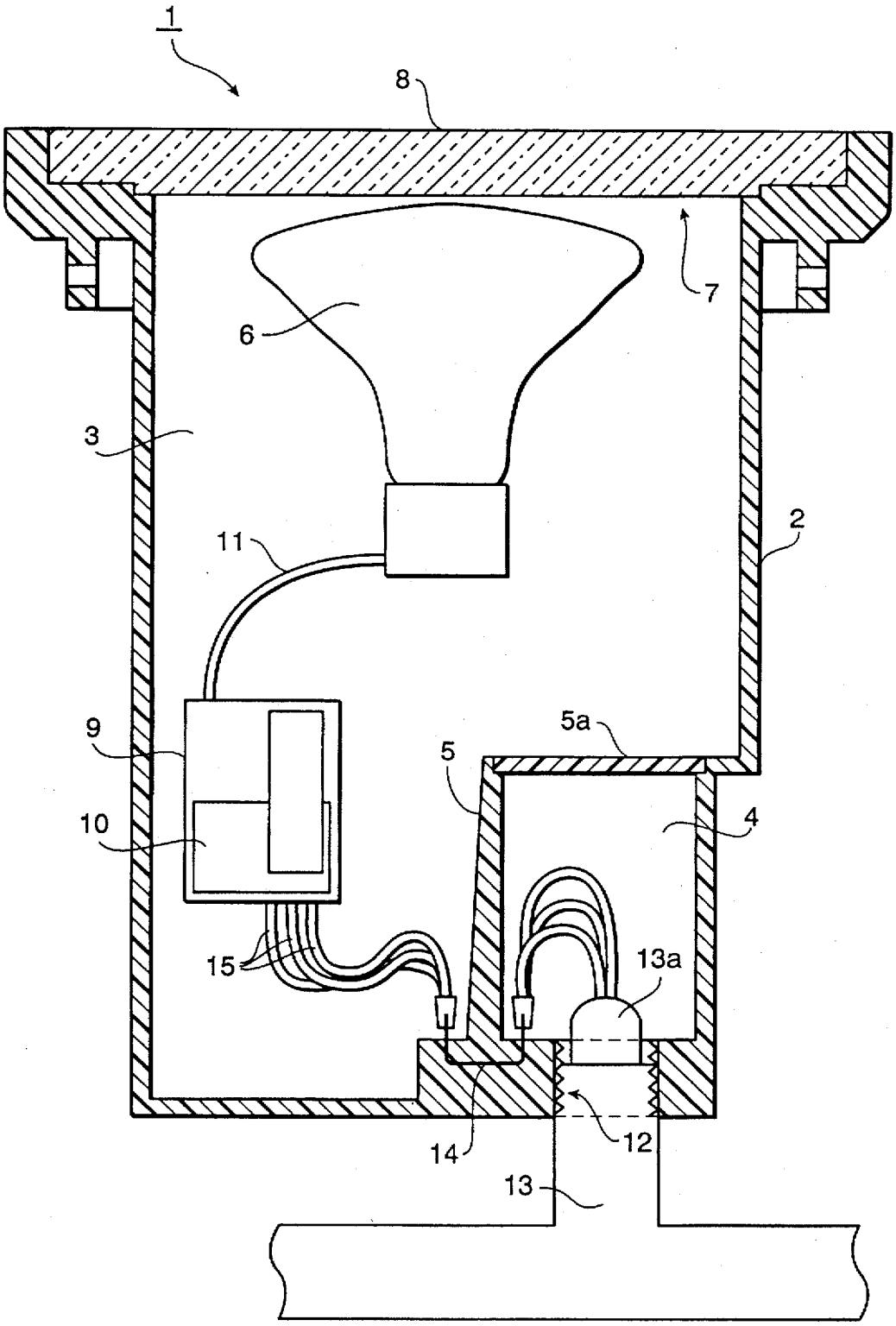
FIG. 1 is a cross-sectional view of the in-ground light fixture according to the invention.

FIG. 1 is a cross-sectional view of the in-ground light fixture according to the invention. As shown in FIG. 1, in-ground light fixture 1 is formed from housing 2, which is preferably a unitary body made from a composite material, such as RhinoLite™, or a plastic material, such as ABS plastic. Housing 2 is molded into at least two chambers, light chamber 3 and power terminal chamber 4, which are separated by common wall 5 and power terminal chamber cover 5*a*. Power terminal chamber cover 5*a* is fastened in a water-tight fashion to common wall 5 and a sidewall of housing 2, for example, with bolts or screws (not shown) and conventional gaskets or seals.

Light chamber 3 contains light source 6, such as an electric bulb (e.g., a flood lamp), which is disposed beneath lens opening 7. Lens assembly 8 is placed over lens opening 7 so as to permit light source 6 to shine out of the in-ground light fixture, possibly through a louver (not shown) disposed either above lens assembly 8 or between light source 6 and lens assembly 8.

Lens assembly 8 is held in place over lens opening 7 by fasteners (not shown) so as to form a water-tight seal between lens assembly 8 and housing 2. Any number of conventional means, such as gaskets, can be used to achieve such a seal between lens assembly 8 and housing 2.

Light chamber 3 also contains electrical components 9, such as ballast 10. Electrical components 9 are connected to light source 6 by means of electrical connection 11, shown in FIG. 1 as a wire connected to a socket.

Power terminal chamber 4 has at least one preferably threaded opening 12 for receiving power conduit 13, which supplies power to in-ground light fixture 1 from an external power source (not shown) via power cable 13*a*. The conduit is preferably made from metal or plastic tubing. A conventional potting compound can be used to help prevent water from entering power terminal chamber 4 through opening 12. Alternatively, conventional gaskets or seals can also be used for this purpose.

Plural conductive elements 14 are molded within common wall 5 so as to provide multiple electrical connections from power terminal chamber 4 to light chamber 3. A greater description of conductive elements 14 will be provided below with respect to FIG. 2. Plural wires from power cable 13 are attached to plural conductive elements 14 in power terminal chamber 4, and plural wires 15 are connected from plural conductive elements 14 to electrical components 9 in light chamber 3. Thus, power can flow from power cable 13 to plural conductive elements 14, and then through plural wires 15 to electrical components 9 and light source 6.

Figure 2:
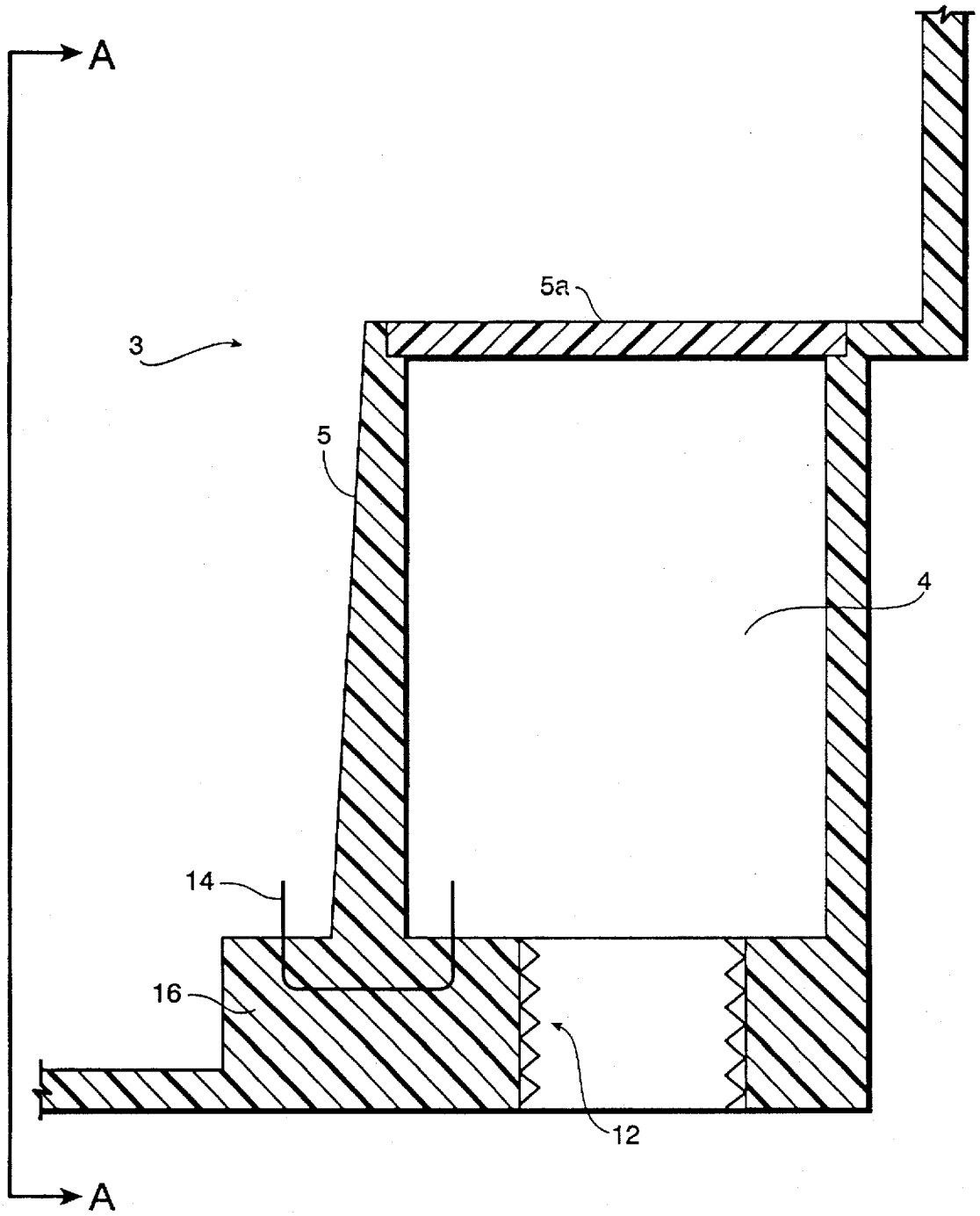
FIG. 2 is a close-up of the disposition of a conductive element of the in-ground light fixture of FIG. 1.

FIG. 2 is a magnified view of the disposition of conductive elements 14 within common wall 5. Plural conductive elements 14 are molded into common wall 5 when housing 2 is molded from a composite material, such as by compression molding or injection molding. Thus, a hermetic seal is advantageously formed between plural conductive elements 14 and common wall 5.

The seal that is formed by molding the conductive elements into the housing wall at the time the housing is formed has several advantages over conventional sealing arrangements. First, the hermetic seal is much more resistant to water trying to force its way into light chamber 3 than conventional seals. Thus, the expensive lighting components such as light source 6 and electrical components 9 are protected from water damage. Second, the hermetic seal should have a much longer life span than a conventional seal, extending the useful life of the entire in-ground light fixture 1. Finally, light source 6 and electrical components 9 are protected from any potting compound needed to seal power terminal chamber 4. In conventional fixtures, the potting compound can foul the electrical components, light source, and connections in the fixture, making any necessary maintenance work much more difficult. As a result of the foregoing advantages, the cost of manufacturing and maintaining the light fixture is less than the cost of manufacturing and maintaining conventional fixtures.

Plural conductive elements 14 are preferably made from a rust-resistant material, such as brass, so as to prevent corrosion in the event that water seeps into power terminal chamber 4. In addition, common wall 5 is preferably thickened at the locations where plural conductive elements 14 are molded into the wall. The wall is thickened in order to form a better seal and in order to reinforce the wall, which may be slightly weakened by having conductive elements 14 molded therein. Such thickening is shown in FIG. 2 as thickened parts 16 of common wall 5.

Figure 3:
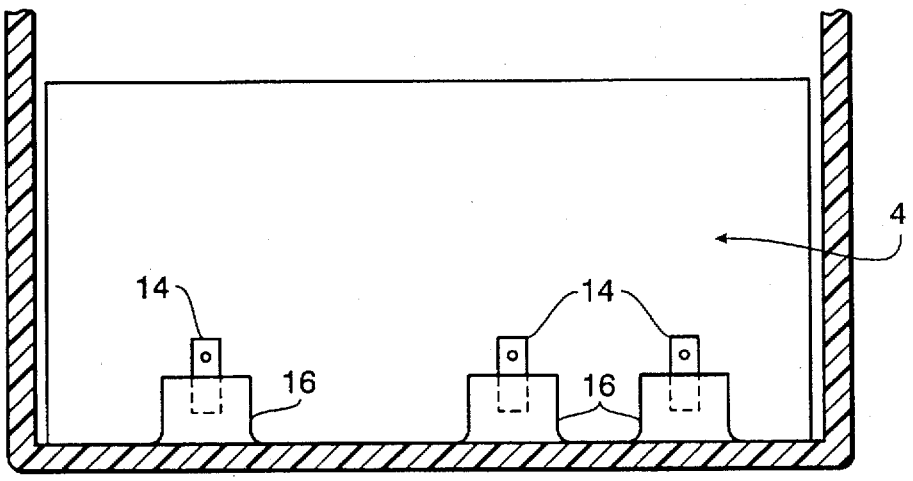
FIG. 3 is a cross-sectional view showing plural conductive elements of the type shown in FIG. 2.

FIG. 3 is a cross-sectional view showing plural conductive elements of the type shown in FIG. 2. This figure is simply a sectional view taken along line A—A in FIG. 2, looking from inside light chamber 3 toward power terminal chamber 4. In the preferred embodiment of the invention, three plural conductive elements 14 are disposed within three thickened parts 16 of common wall 5. The three conductive elements are for power, ground, and neutral lines. Alternatively, any number of conductive elements can be used depending on the circumstances. For example, an additional conductive element may be used for a control line.

By means of the foregoing construction, the problem of water siphoning or wicking into light chamber 3 is addressed. Because plural conductive elements 14 are directly molded into thickened parts 16 of common wall 5, a hermetic seal is formed between plural conductive elements 14 and the material comprising common wall 5. Thus, water cannot wick or siphon along the wires of power cable 13*a* into light chamber 3, even if the water is under pressure. Therefore, this construction advantageously helps prevent water from entering light chamber 3, which otherwise could result in damage to or shorting-out of the costly light source 6 and electrical components 9.

In another embodiment, an in-ground light is adaptable for use as an elevated landscape light so as to provide lighting above grade level. The adaptable light includes a light housing having an opening for receiving a lens, an opening for receiving a power cable, at least one chamber containing electrical components and a light source, and a lip extending from the housing. The lip has at least one boss extending therefrom and has a diameter greater than a diameter of the housing. The adaptable light also includes an elongated base having a length greater than the length of the housing and having an open end adapted to receive the housing. The open end has an inside diameter less than the diameter of the lip and greater than the diameter of the housing. The adaptable light also includes at least one fastener for fastening the elongated base to the at least one boss that extends from the lip.

The in-ground light adaptable for use as an elevated light has several advantages over conventional lights that can only be installed at grade level. First, the adaptable light can be inexpensively elevated so as to provide lighting in areas covered by low-growing shrubs and other plants. For example, the adaptable light is ideal for up-lighting a tree that is surrounded by shrubs or flowers. Conventional grade-level up-lighting would be obscured by such shrubs or flowers; the adaptable light can be easily raised above those obstructions. Second, the adaptable light can be used with a wide variety of elongated bases, allowing greater flexibility in its use.

Figure 4:
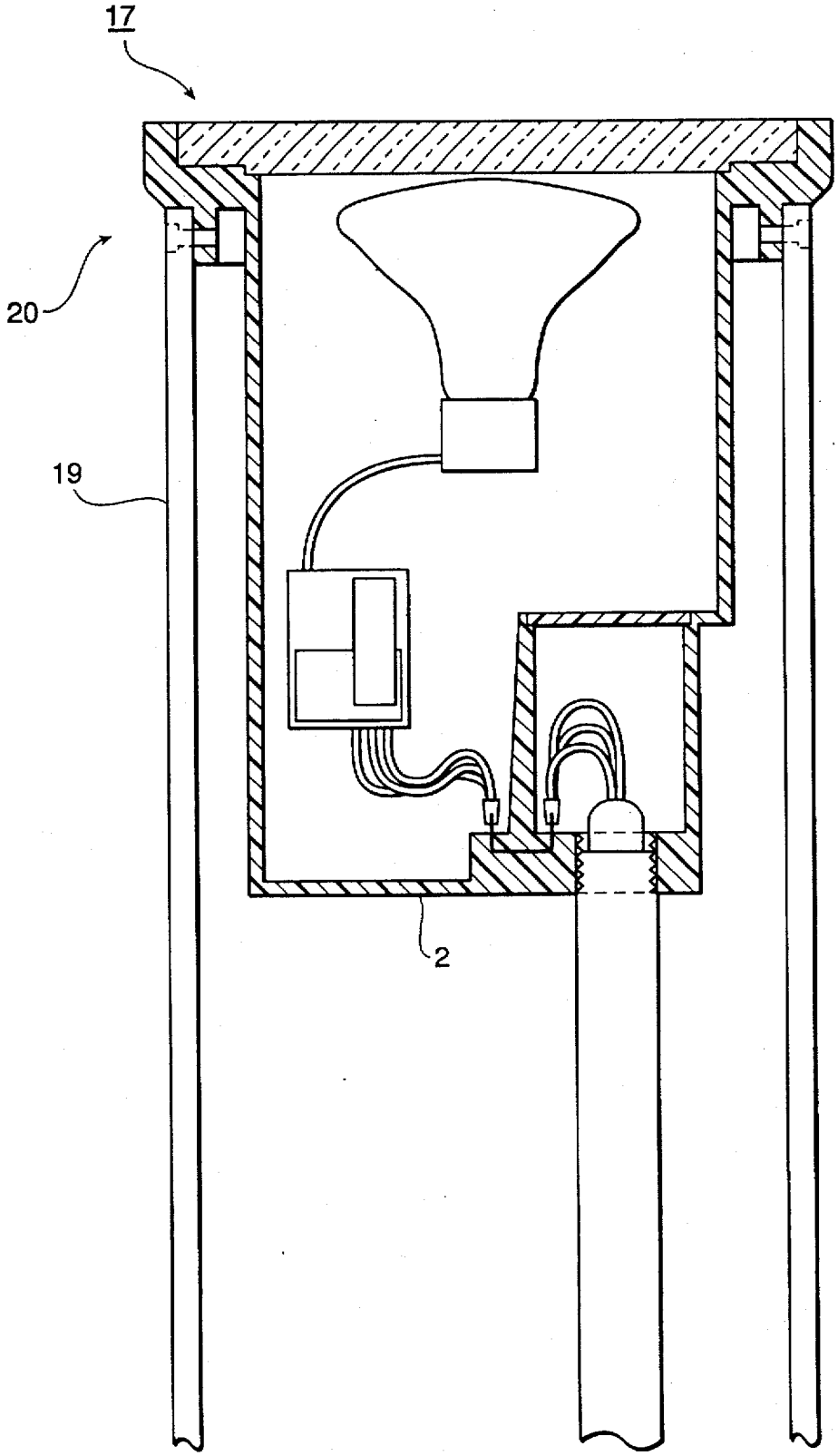
FIG. 4 is a cross-sectional view of an in-ground light adapted for use as an elevated landscape light.

FIG. 4 is a cross-sectional view of an in-ground light adaptable for use as an elevated landscape light. Elevated landscape light 17 includes housing 2 of an in-ground light disposed within elongated base 19. Lip 20 extends from housing 2. The diameter of lip 20 is greater than the diameter of housing 2 and greater than the diameter of the opening in elongated base 19. This construction allows housing 2 to fit partially within elongated base 19 without sliding completely into elongated base 19.

Power conduit 13, which encloses power cable 13*a*, extends from housing 2 through elongated base 19. Thus, power cable 13*a* is protected from external hazards, such as lawn mowers, by elongated base 19.

Figure 5:
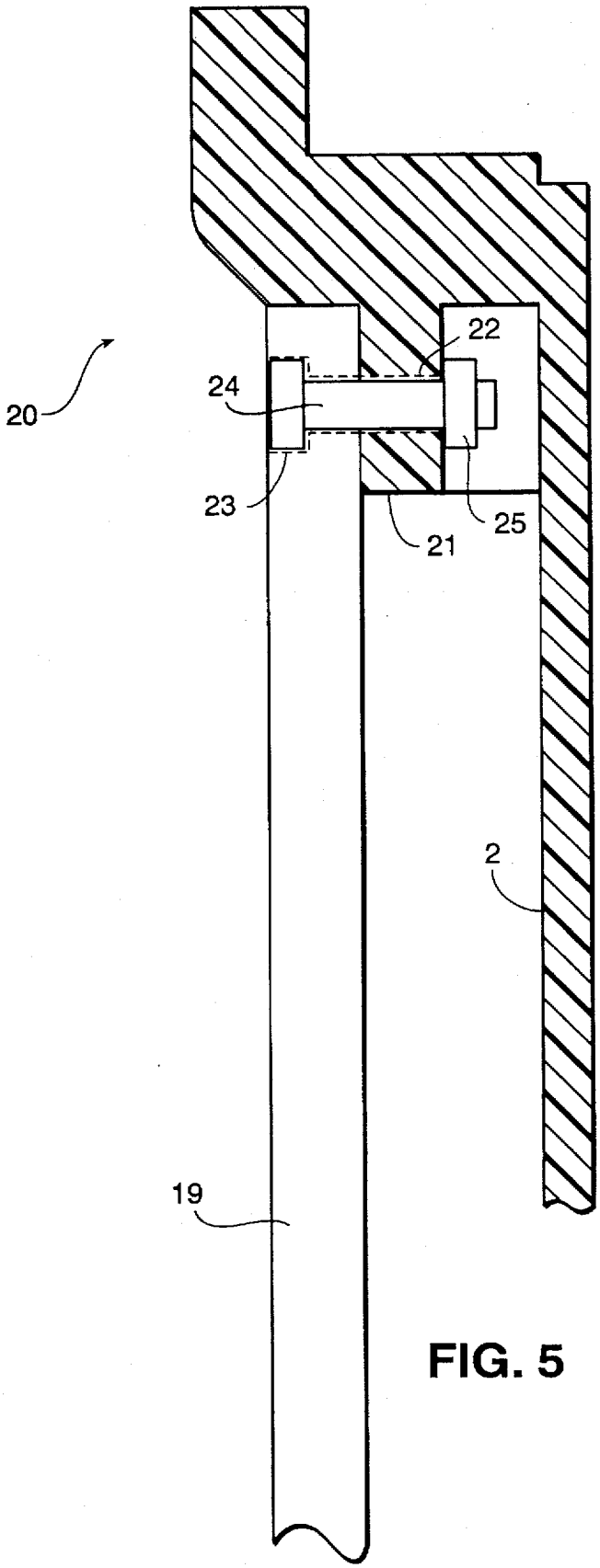
FIG. 5 is a close-up of the lip of the in-ground light of FIG. 4.

FIG. 5 is a magnified view of lip 20. Lip 20 extends beyond the top edge of elongated base 19. One of several bosses 21 extends downward from lip 20. Fastener hole 22 in boss 21 aligns with fastener hole 23 in elongated base 19, and fastener bolt 24 passes through both holes so as to securely attach lip 20 to elongated base 19. Fastener hole 23 is recessed so that fastener bolt 24 can lie flush with the exterior of elongated base 19. In order to provide a secure attachment, nut 25 is provided to receive fastener bolt 24. Alternatively, fastener hole 22 in boss 21 is threaded to receive fastener bolt 24.

Figure 6:
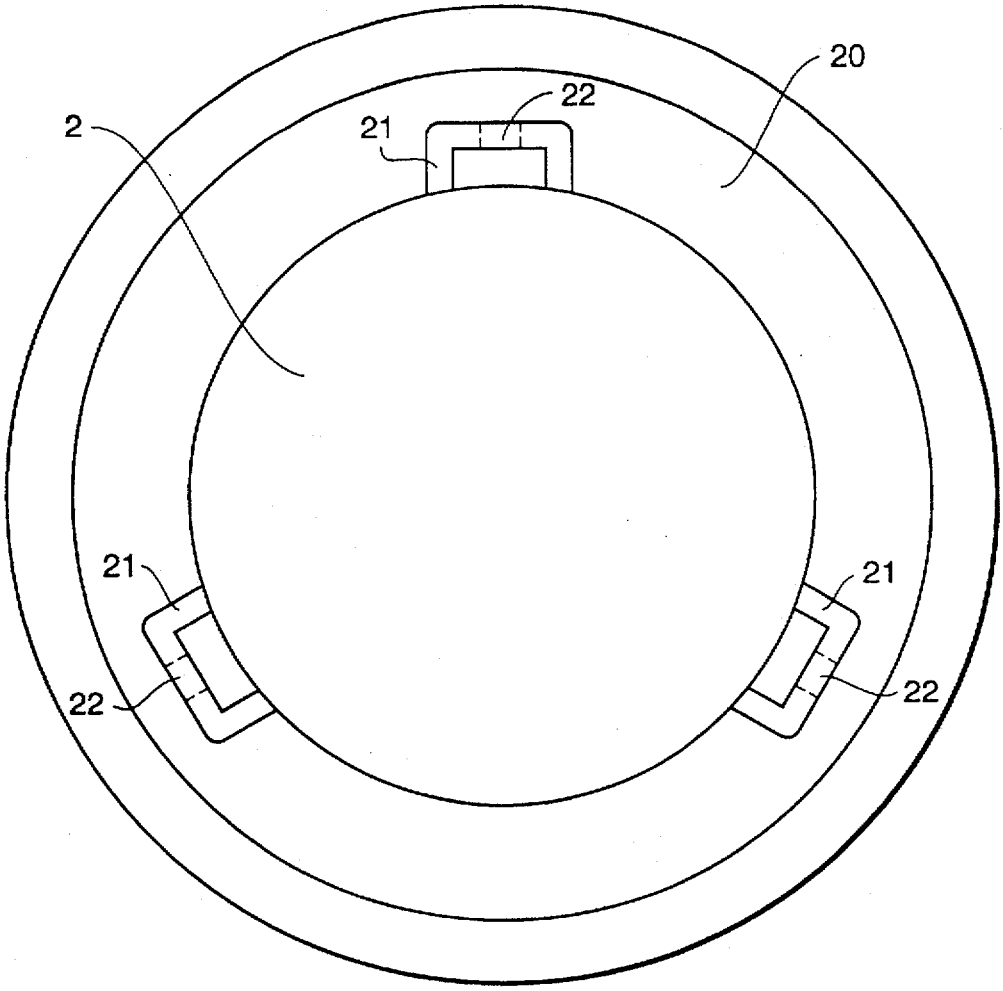
FIG. 6 is a bottom view of the in-ground light of FIG. 4 showing the disposition of three bosses.

FIG. 6 is a bottom view of in-ground light housing 2, showing the disposition of three bosses 21 extending below lip 20 around the periphery of housing 2. As shown in this figure, each boss 21 has fastener hole 22. In addition, in the preferred embodiment, each boss 21 is U-shaped so as to hold nut 25 more securely.

Figure 7:
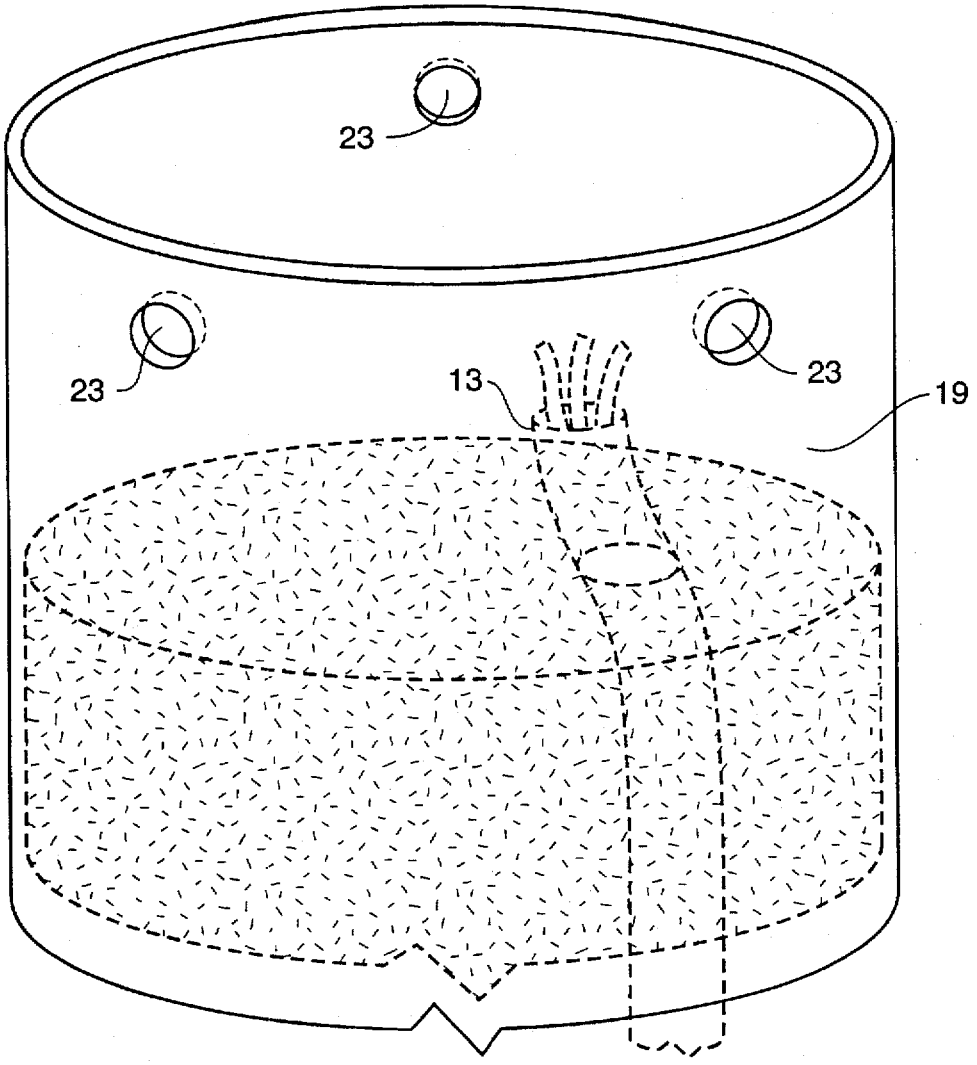
FIG. 7 is a perspective view of a elongated base for use with the in-ground light of FIG. 4.

FIG. 7 shows elongated base 19. Three fastener holes 23 are preferably spaced equidistant around the top of elongated base 19. Elongated base 19 can be made of any suitably strong and weather-resistant material, such as a composite material, plastic, aluminum, or galvanized steel. While elongated base 19 is shown as a cylinder in FIG. 7, elongated base 19 may have any shape. Thus, if housing 2 has a square shape, then elongated base 19 can have a square shape. Alternatively, an adapter (not shown) could be used to attach a light housing with one shape to an elongated base with a different shape. For example, an adapter could be used to attach a square housing to a cylindrical elongated base.

In addition, as shown by the hatching in FIG. 7, elongated base 19 can be partially filled with some type of material, such as dirt, sand, gravel, cement or concrete, in order to increase the strength of the elongated base. In this case, elongated base 19 must be hollow at its top so that housing 2 can be inserted substantially therein. Also, power conduit 13 must be embedded in the material so that power can be supplied to the light.

Figure 8:
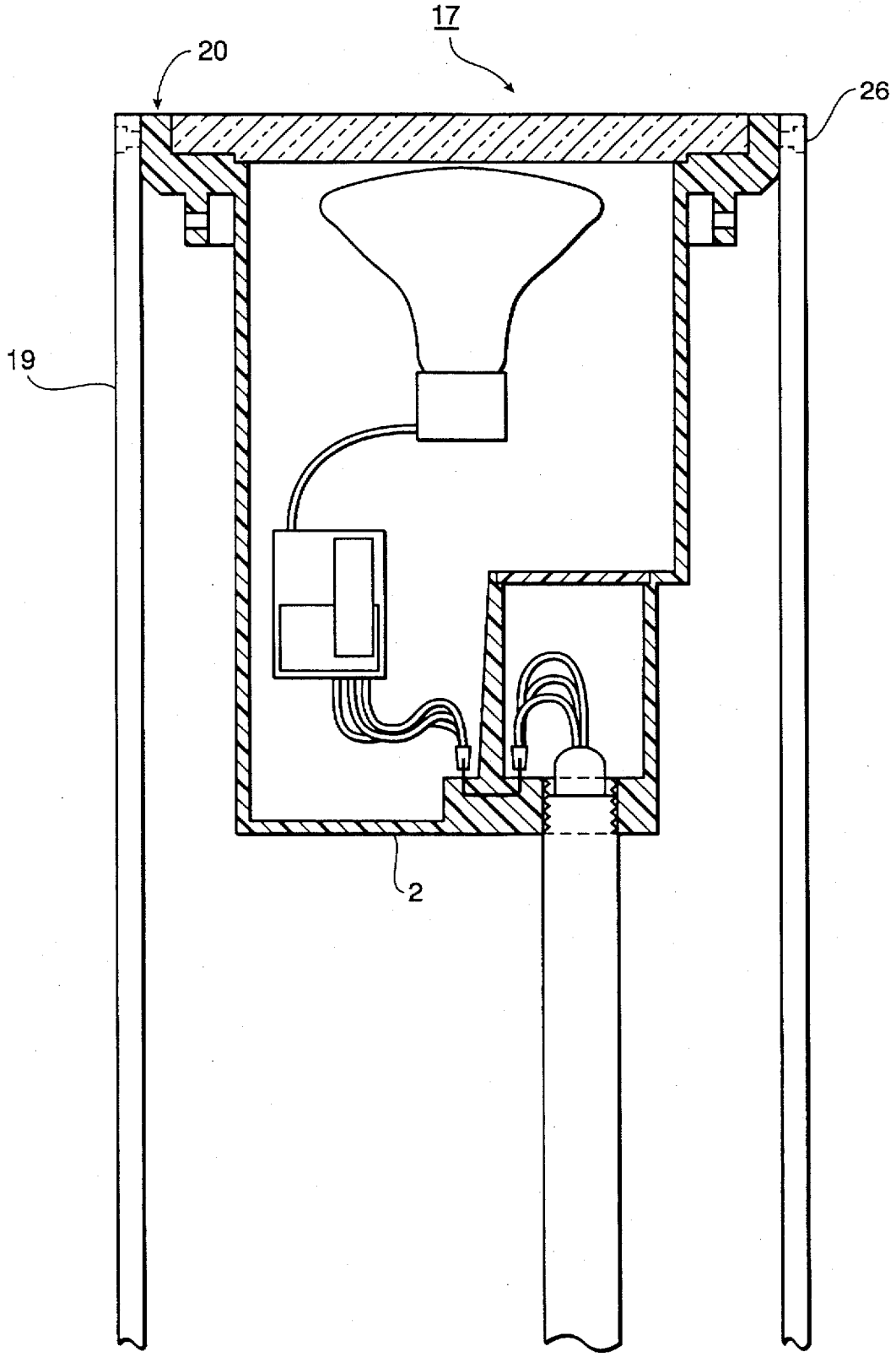
FIG. 8 is a cross-sectional view of an alternative embodiment of an in-ground light adapted for use as an elevated landscape light.

FIG. 8 is a cross-sectional view of an alternative embodiment of the in-ground light adapted for use as an elevated landscape light. In the alternative embodiment, housing 2 fits entirely within elongated base 19. Fastening means 26 are used to fasten housing 2 to elongated base 19. As shown in FIG. 8, lip 20 has means for receiving fastening means along its outer side. When lip 20 receives fastening means 26, light housing 2 is fastened into base 19. The fastening means may be comprised of bolts or screws which fasten housing 2 to elongated base 19, comprised of threading which surrounds the entire exterior of lip 20 so as to screw into matching threading around the interior of elongated base 19, or comprised of glue or epoxy.

The invention has been described with respect to two particular illustrative embodiments. It is to be understood that the invention is not limited to the above-described embodiments and modifications thereof, and that various changes and modifications may be made by those of ordinary skill in the art without departing from the spirit and scope of the appended claims.

What is claimed is:

1. An in-ground light fixture comprising:

a single unitary body having a first chamber and a second chamber, the first chamber and the second chamber being separated by a common wall; and plural conductive elements, each of which is molded within the common wall separating the first chamber and the second chamber and each of which forms a conductive pathway between the first chamber and the second chamber, wherein the first chamber contains at least electrical components and a light source, and has an opening for receiving a lens, and the second chamber has an opening adapted to receive a power conduit supplying power from an external power source, wherein the plural conductive elements are molded within the common wall of the single unitary body of the in-ground light fixture by molding the common wall around the plural conductive elements when said common wall is forked, the plural conductive elements permitting power to be supplied from the second chamber to the electrical components and the light source in the first chamber.

2. The in-ground light fixture of claim 1, wherein the single unitary body is molded from a composite material.

3. The in-ground light fixture of claim 1, wherein the light source is an electric bulb.

4. The in-ground light fixture of claim 1, further comprising a lens assembly placed in the opening for receiving a lens in the first chamber.

5. The in-ground light fixture of claim 1, further comprising a sealing compound used to seal the opening adapted to receive a power conduit in the second chamber.

6. An in-ground light fixture comprising:

a chamber containing at least electrical components and a light source, and having an opening for receiving a lens; and plural conductive elements, each of which is molded within a wall of the chamber and each of which forms a conductive pathway from outside of the chamber to inside of the chamber, wherein the plural conductive elements are molded within the wall of the in-ground light fixture by molding the wall around the plural conductive elements when said wall is formed, the plural conductive elements permitting power to be supplied from outside of the chamber to the electrical components and the light source inside of the chamber.

7. The in-ground light fixture of claim 6, wherein the wall is molded from a composite material.

8. An in-ground light fixture comprising:

a single unitary body having a first chamber and a second chamber, the first chamber and the second chamber being separated by a common wall; and at least one conductive element which is molded within the common wall separating the first chamber and the second chamber and which forms a conductive pathway between the first chamber and the second chamber, wherein the at least one conductive element is molded within the common wall of the single unitary body of the in-ground light fixture by molding the common wall around the at least one conductive element when said common wall is formed, the at least one conductive element permitting power to be supplied from the second chamber to the first chamber.

9. The in-ground fixture of claim 8, wherein the first chamber contains electrical components.

10. The in-ground fixture of claim 9, further comprising a light source controlled by the electrical components.

11. The in-ground fixture of claim 10, wherein the light source is an electric bulb.

12. The in-ground fixture of claim 8, wherein the second chamber has an opening adapted to receive power from an external power source.

13. The in-ground fixture of claim 12, wherein a power cable supplying power from the external power source is connected to the at least one conductive element.

14. An in-ground light housing comprising:

plural walls, at least one of the plural walls preventing water from entering the housing; and at least one conductive element molded within the at least one of the plural walls so as to form a conductive pathway from one side of the at least one of the plural walls to an other side of the at least one of the plural walls, wherein the at least one conductive element is molded within the at least one of the plural walls by molding the at least one of the plural walls around the at least one conductive element when said at least one of the plural walls of the in-ground light housing is formed.

15. The housing of claim 14, wherein the plural walls are molded from a composite material.

16. The housing of claim 14, wherein the at least one of the plural walls is molded from a composite material.

17. The housing of claim 14, further comprising electrical components contained in the housing.

18. The housing of claim 17, wherein the electrical components receive power from the at least one conductive element.

19. An in-ground light adaptable for use as an elevated landscape light so as to provide lighting above grade level, comprising:

an in-ground light housing having at least a top, a side substantially perpendicular to the top, an opening for receiving a lens in the top, an opening for receiving a power conduit, at least one chamber containing at least electrical components and a light source, and a lip extending from the light housing, the lip having at least one boss extending therefrom and having a diameter greater than a diameter of the light housing, the at least one boss being adapted to receive at least one fastener in a direction substantially perpendicular to the side of the light housing;

an elongated base having a length greater than a length of the light housing and having an open end adapted to receive the light housing, the open end having an inside diameter less than the diameter of the lip and greater than the diameter of the light housing; and at least one fastener for fastening the elongated base to the at least one boss that extends from the lip.

20. An in-ground light adaptable for use with an elongated base so as to provide landscape lighting above grade level comprising:

an in-ground light housing having a top, a side substantially perpendicular to the top, at least an opening for receiving a lens in the top, an opening for receiving a power cable, at least one chamber containing electrical components and a light source, and a lip extending from the light housing, the lip having at least one boss extending therefrom and having a diameter greater than a diameter of the light housing, the at least one boss being adapted to receive at least one fastener an a direction substantially perpendicular to the side of the light housing; and at least one fastener for fastening the elongated base to the at least one boss that extends from the lip.

21. An in-ground light adaptable for use as an elevated landscape light so as to provide lighting above grade level, comprising:

light housing means for housing at least electrical components and a light source, said light housing means having at least a top, a side substantially perpendicular to the top, one chamber, an opening for receiving a lens in the top, an opening for receiving power, and a lip extending from said light housing means, said lip having means for receiving fastening means in a direction substantially perpendicular to the side of the light housing means;

elongated base supporting means for supporting the light housing means above grade level, the elongated base supporting means having a length greater than a length of the light housing means and having receiving means for receiving the light housing means; and fastening means for fastening the light housing means of the in-ground light to the elongating means, wherein, when said lip receives said fastening means, the light housing means is fastened within the elongating means such that the in-ground light, which is normally adapted to be at grade level, is adapted to be elevated above grade level.

* * * * *

UNITED STATES PATENT AND TRADEMARK OFFICE

CERTIFICATE OF CORRECTION

PATENT NO. : 5,743,622

DATED : April 28, 1998

INVENTOR(S) : Ibbitson et al.

It is certified that error appears in the above-identified patent and that said Letters Patent is hereby corrected as shown below:

COLUMN 6:

Line 26, "forked," should read --formed,--.

COLUMN 8:

Line 21, "an" should read --in--.

Signed and Sealed this

Fifth Day of January, 1999

*Attest:*

*Attesting Officer*

*Acting Commissioner of Patents and Trademarks*